US008033058B2

(12) United States Patent
Block

(10) Patent No.: US 8,033,058 B2
(45) Date of Patent: Oct. 11, 2011

(54) APPARATUS FOR DIVERTING RAINWATER

(75) Inventor: Andrew P. Block, Middleton, WI (US)

(73) Assignee: Fiskars Brands, Inc., Madison, WI (US)

( * ) Notice: Subject to any disclaimer, the term of this patent is extended or adjusted under 35 U.S.C. 154(b) by 354 days.

(21) Appl. No.: 12/431,523

(22) Filed: Apr. 28, 2009

(65) Prior Publication Data

US 2010/0270219 A1 Oct. 28, 2010

(51) Int. Cl.
*E04D 13/08* (2006.01)
*B01D 35/02* (2006.01)

(52) U.S. Cl. ..... 52/12; 52/16; 210/162; 210/234; 210/251; 210/433.1; 210/446; 210/447; 210/456; 210/459

(58) Field of Classification Search ..... None
See application file for complete search history.

(56) References Cited

U.S. PATENT DOCUMENTS 289,473 A * 12/1883 Van Tassel ..... 210/447
522,667 A * 7/1894 Minnemyer ..... 210/447
527,400 A * 10/1894 Barth ..... 210/421
543,922 A * 8/1895 Buckley ..... 210/249
608,765 A * 8/1898 Epple ..... 137/873
1,044,601 A * 11/1912 Thiem ..... 210/447
1,076,075 A * 10/1913 Steele ..... 210/447
1,188,280 A * 6/1916 Kuenzli ..... 210/433.1
1,254,125 A * 1/1918 Dash ..... 210/433.1
1,283,278 A * 10/1918 Ott ..... 210/340
1,653,473 A * 12/1927 Otto ..... 210/130
2,463,814 A * 3/1949 Skinner ..... 210/354
2,494,780 A * 1/1950 Schmidt ..... 210/357
2,532,388 A * 12/1950 Batt, Jr. ..... 210/447
2,595,538 A * 5/1952 Rausch ..... 210/238
2,887,073 A * 5/1959 Thompson ..... 52/16
2,966,171 A * 12/1960 Kotlar ..... 137/561 R
3,421,629 A * 1/1969 Hehr ..... 210/232
3,465,885 A * 9/1969 Trump ..... 210/447
3,628,668 A * 12/1971 Huppert ..... 210/446
3,956,133 A * 5/1976 Arnold ..... 210/232
3,990,474 A 11/1976 Harms
4,120,790 A * 10/1978 Tinker et al. ..... 210/767
4,182,376 A 1/1980 Nilsson
4,183,368 A * 1/1980 Husted ..... 134/166 R
D260,422 S * 8/1981 Husted ..... D23/209
4,411,110 A 10/1983 Carey
4,447,325 A * 5/1984 Pauley ..... 210/295
(Continued)

OTHER PUBLICATIONS

U.S. Appl. No. 29/333,772, filed Mar. 13, 2009, Block.

(Continued)

*Primary Examiner* — Robert James Popovics
(74) *Attorney, Agent, or Firm* — Foley & Lardner LLP

(57) ABSTRACT

An apparatus for diverting rainwater includes a body having a top portion, a bottom portion, and a central portion. A diverter is disposed within the central portion, and has a lower portion and an upper portion. The lower portion of the diverter, together with one or more walls of the body, defines a containment configured to capture rainwater that enters through the top portion. An opening in at least one of the walls of the body is configured to divert rainwater from the containment. The body also includes a bypass flow area extending through the central portion adjacent to, and separate from, the containment, where the bypass flow area has a cross-sectional area that is substantially equal to or greater than a cross sectional area of the top and bottom portions.

7 Claims, 9 Drawing Sheets

U.S. PATENT DOCUMENTS 4,470,908 A * 9/1984 Odekirk ..... 210/463
4,472,274 A 9/1984 Williams
4,523,875 A * 6/1985 DiFiore ..... 405/50
4,615,153 A * 10/1986 Carey ..... 52/12
D288,230 S 2/1987 Thatcher
D288,840 S 3/1987 Williams
4,667,448 A 5/1987 Smith
4,732,037 A 3/1988 Daube, Jr. et al.
4,786,205 A 11/1988 Hisken et al.
4,798,028 A 1/1989 Pinion
4,801,377 A 1/1989 Bolt
5,099,620 A 3/1992 Carey
5,114,594 A 5/1992 Rosebrock et al.
5,230,798 A * 7/1993 Rogman ..... 210/447
5,261,195 A 11/1993 Buckenmaier et al.
5,261,196 A 11/1993 Buckenmaier et al.
5,305,562 A 4/1994 Sapia
5,332,332 A 7/1994 Kenyon, Jr.
D354,552 S 1/1995 Weber
5,383,310 A 1/1995 Sapia
5,406,756 A * 4/1995 Bemis et al. ..... 52/16
5,406,966 A * 4/1995 Lepkowski et al. ..... 134/104.4
5,452,546 A * 9/1995 Goddard ..... 52/12
5,511,829 A * 4/1996 Sicotte et al. ..... 285/148.22
5,516,232 A 5/1996 Filipski
5,522,427 A 6/1996 Johnson
5,526,612 A * 6/1996 Wade ..... 52/12
5,533,303 A 7/1996 Harvey
5,557,891 A 9/1996 Albracht
5,567,077 A 10/1996 Yang
D381,406 S 7/1997 Brown
5,673,519 A 10/1997 McCaughan
5,709,051 A 1/1998 Mazziotti
5,862,632 A * 1/1999 Zima ..... 52/16
5,863,151 A * 1/1999 Chapotelle ..... 405/52
5,882,508 A * 3/1999 St-Jacques ..... 210/87
5,985,158 A 11/1999 Tiderington
6,024,127 A 2/2000 Johnson
6,182,680 B1 2/2001 Hart
6,219,972 B1 * 4/2001 Zusy ..... 52/12
6,240,679 B1 * 6/2001 Smalara ..... 52/16
6,248,233 B1 * 6/2001 Priggemeyer et al. ..... 210/162
6,263,618 B1 * 7/2001 Jones ..... 52/12
6,282,844 B1 9/2001 Marable
6,308,479 B1 10/2001 Prohofsky
6,374,944 B1 4/2002 Curl, Jr.
6,453,622 B1 9/2002 Walters
6,470,628 B1 10/2002 Walters
6,481,164 B1 11/2002 McCorkel
6,497,816 B2 * 12/2002 Naddy ..... 210/162
6,536,165 B2 3/2003 Pilcher
6,568,132 B1 5/2003 Walters
6,576,123 B2 * 6/2003 Priggemeyer et al. ..... 210/155
6,584,733 B2 * 7/2003 Wade ..... 52/14
6,619,312 B2 9/2003 Doiron
6,647,670 B1 * 11/2003 Dran ..... 52/16
6,701,675 B1 * 3/2004 Ekker et al. ..... 52/16
6,705,049 B2 * 3/2004 Esmond et al. ..... 52/16
6,880,294 B2 4/2005 Walters
6,887,375 B2 5/2005 Johnson
7,007,429 B2 3/2006 Kim
7,141,158 B2 * 11/2006 Hong ..... 210/156
7,395,633 B2 * 7/2008 Baeta ..... 52/16
D589,127 S 3/2009 Cornwall
7,550,077 B2 * 6/2009 Graf ..... 210/162
7,584,577 B2 * 9/2009 Esmond et al. ..... 52/12
D616,970 S * 6/2010 Block ..... D23/267
7,775,232 B2 * 8/2010 Takai ..... 137/122
7,780,013 B1 * 8/2010 Kern ..... 210/435
7,805,890 B2 * 10/2010 Esmond et al. ..... 52/12
7,895,793 B1 * 3/2011 Yates ..... 52/12
7,919,002 B1 * 4/2011 Hurtado ..... 210/162
2001/0022052 A1 9/2001 Pilcher
2003/0029129 A1 2/2003 Walters
2003/0051414 A1 * 3/2003 Bessette ..... 52/16
2003/0101661 A1 6/2003 Walters
2003/0131542 A1 7/2003 Coblentz, Jr.
2005/0109693 A1 5/2005 Allard
2005/0257433 A1 * 11/2005 Dussault et al. ..... 52/12
2006/0186697 A1 8/2006 Whitcomb
2007/0209289 A1 9/2007 Garcia
2008/0086953 A1 * 4/2008 Graf ..... 52/12
2010/0270219 A1 * 10/2010 Block ..... 210/162

OTHER PUBLICATIONS

The Garden Watersaver, "Automatic Rainwater Collection System", available at http://nexuscms.com/smarty/gallery2.php?page=1&gallery_id=1& . . ., available at least by Feb. 9, 2009 (1 pg.).
RainReserve, "A Fluid Solution to Conservation", available at http://www.rainreserve.com/how.php, available at least by Feb. 9, 2009 (1 pg.).
WISY, "Rainwater harvesting systems", Product List 2007 (22 pgs.).

* cited by examiner

APPARATUS FOR DIVERTING RAINWATER

FIELD

The present invention relates to an apparatus for diverting rainwater. The present invention relates more particularly to a rainwater diverter that is configured for placement in a downspout of a rain gutter system for a building. The present invention relates more particularly to a rainwater diverter that has a removable diverter insert that when installed, diverts rainwater to a collection device, and when removed permits unimpeded flow of rainwater through the downspout without diverting rainwater to the collection device.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

It would be desirable to provide an improved apparatus for diverting rainwater from the downspout of a rain gutter system for a building. However, the problems posed by this type of arrangement are complex because the known diverters tend to capture debris (e.g. leaves, dirt, ice, insects, etc.) that often results in clogging of the downspout and unreliable delivery of rainwater to an intended collection device. For example, the known diverters tend to have structure that reduces the effective flow area through the downspout, or do not redirect the rainwater back through the downspout when the containment device is full, or that are not easy to clean, or that do not filter the rainwater being diverted to the collection device, or that include moving parts that reduce the reliability of the diverter.

Accordingly, it would be desirable to provide an apparatus for diverting rainwater from a downspout of a rain gutter system on a building (or other appropriate structure) that does not reduce the effective flow area through the downspout, and that redirects the rainwater back through the downspout when the collection device is full, and that is easy to clean, and that filters the rainwater being diverted to the collection device, and that does not require moving parts for its operation.

SUMMARY

According to one embodiment, an apparatus for diverting rainwater includes a body having a top portion, a bottom portion, and a central portion. A diverter is disposed within the central portion, and has a lower portion and an upper portion. The lower portion of the diverter, together with one or more walls of the body, defines a containment configured to capture rainwater that enters through the top portion. An opening in at least one of the walls of the body is configured to divert rainwater from the containment. The upper portion of the diverter has apertures configured to permit passage of rainwater from the top portion to the containment.

According to another embodiment, an apparatus for diverting rainwater includes a body having a top portion, a bottom portion, and a central portion. A diverter is disposed within the central portion, and has a lower portion and an upper portion. The lower portion of the diverter, together with one or more walls of the body, defines a containment configured to capture rainwater that enters through the top portion. An opening in at least one of the walls of the body is configured to divert rainwater from the containment. The body also includes a bypass flow area extending through the central portion adjacent to, and separate from, the containment, where the bypass flow area has a cross-sectional area that is substantially equal to or greater than a cross sectional area of the top and bottom portions.

According to a further embodiment, an apparatus for diverting rainwater includes a body having a top portion, a bottom portion, and a central portion. A diverter is disposed within the central portion, and has a lower portion and an upper portion. The lower portion of the diverter, together with one or more walls of the body, defines a containment configured to capture rainwater that enters through the top portion. An opening in at least one of the walls of the body is configured to divert rainwater from the containment. The diverter is removably attached to the body, so that with the diverter removed the rainwater flows substantially unimpeded from the top portion to the bottom portion without being diverted through the opening.

DETAILED DESCRIPTION

Figure 1:
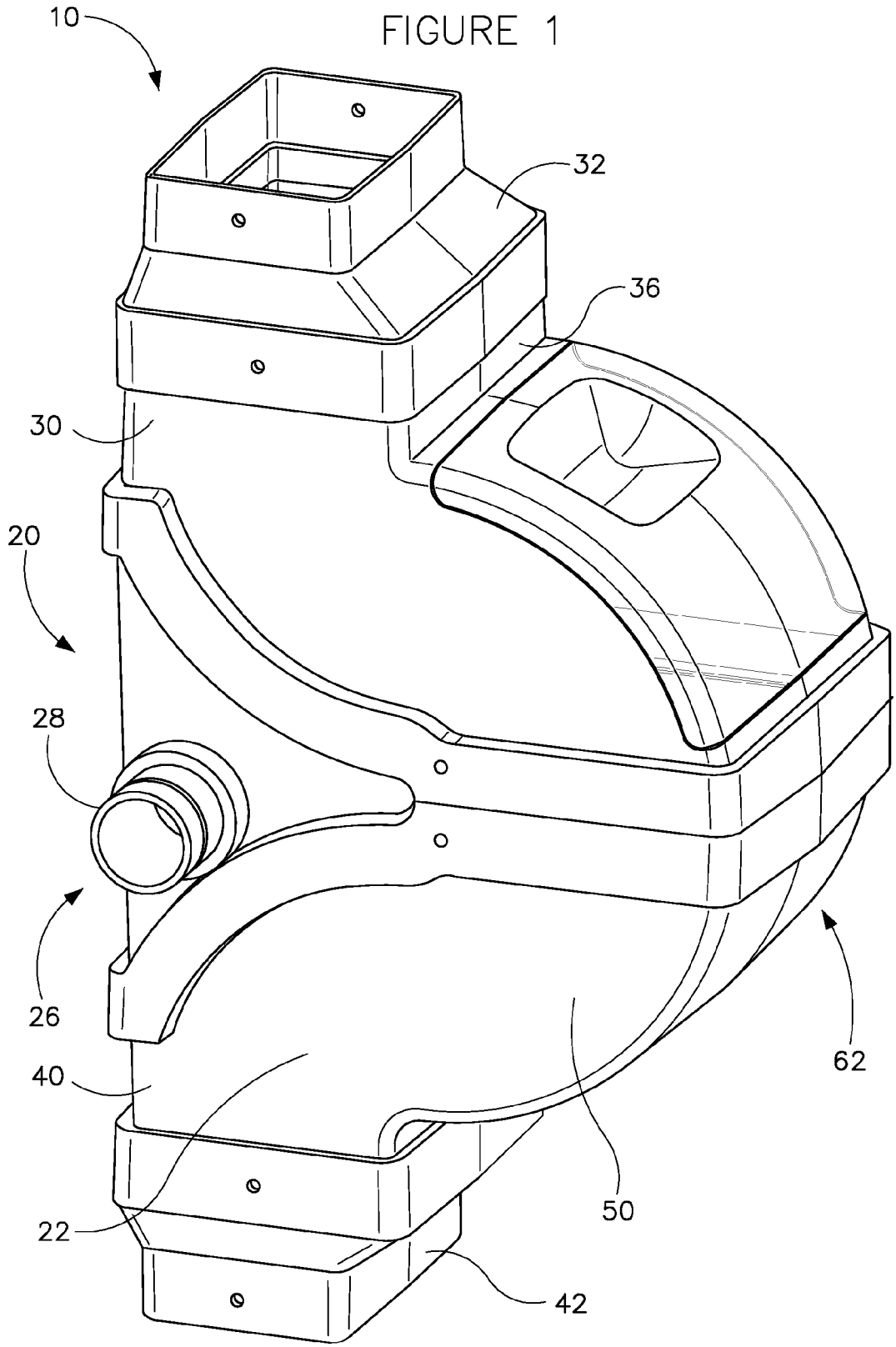
FIG. 1 is a schematic image of a perspective view of an apparatus for diverting rainwater according to an exemplary embodiment.

Referring to the FIGURES, an apparatus is shown according to an exemplary embodiment for diverting rainwater from a downspout of a rain gutter system on a building (or other appropriate structure) that does not reduce the effective flow area through the downspout, and that redirects the rainwater back through the downspout when the collection device is full, and that is easy to clean, and that filters the rainwater being diverted to the collection device, and that does not require moving parts or mechanisms for its operation.

According to the illustrated embodiment, the apparatus for diverting rainwater includes a body having a top portion, a bottom portion, and a central portion. A removable diverter insert is disposed within the central portion, and has a lower portion and an upper portion. The lower portion of the diverter, together with certain walls of the body, defines a containment configured to capture rainwater that enters through the top portion. An opening in at least one of the walls of the body is configured to divert rainwater from the containment to a collection device such as a vessel (e.g. rain barrel, tank, etc.) or other collection device (e.g. retention pond, reservoir, etc.). The body also includes a bypass flow area extending through the central portion adjacent to, and separate from, the containment, where the bypass flow area has a cross-sectional area that is substantially equal to or greater than a cross sectional area of the top and bottom portions, so that a flow area through the downspout is not reduced by the removable diverter insert. When the diverter is removed from the central portion of the body, the rainwater flows substantially unimpeded through the downspout (i.e. from the top portion to the bottom portion of the apparatus without being diverted through the opening). The apparatus and its components may be made of any suitable material such as plastic, and manufactured by any suitable process such as a molding process.

Although specific examples are shown and described throughout this disclosure, the embodiments illustrated in the FIGURES are shown by way of example, and any of a wide variety of other configurations, shapes, sizes and locations of components, and combinations thereof, will be readily apparent to a person of ordinary skill in the art after reviewing this disclosure. Further, although the apparatus has been shown and described by way of example for use with a rain gutter downspout, the apparatus is capable of use in a wide variety of other applications where diversion of a fluid is desirable. All such variations of an apparatus for diverting rainwater are intended to be within the scope of the invention.

Referring more particularly to FIGS. 1-10, an apparatus 10 for diverting rainwater from a rain gutter downspout 12 is shown according to an exemplary embodiment. The apparatus 10 is shown to include a body 20 having a top portion 30, a bottom portion 40, and a central portion 50. The top and bottom portions 30, 40 are vertically aligned with one another and may also include adapters 32, 42 (e.g. collars, sleeves, fitments, etc.) which may be removably attached to (e.g. by snap-fit, etc.), or integrally formed with, the body 20 (see FIG. 10) and are intended to connect the body 20 to an opening in a downspout 12. For example, an upper downspout segment may fit inside the adapter at the top portion and the adapted at the bottom portion may fit inside of the lower downspout segment. The top portion 30 and bottom portion 40 are each shown to have a substantially rectangular cross section defining a flow area at least as large and a flow area of the downspout and creating a flow passage that is substantially parallel with the flow passage of a downspout.

The central portion 50 of the body 20 includes a first region 52 shown having a generally planar first side 54 that is substantially coplanar with a corresponding side 34, 44 of the top and bottom portion and extends substantially parallel to the downspout, and a second region 56 having a generally curved shape (e.g. semi-circular, hemispherical, convex, rounded, protruded, etc.) that extends or projects outwardly from the first region 52 and the corresponding second side 36, 46 of the top and bottom portions 30,40. The first region 52 of the central portion 50 of the body 20 defines a first flow passage 58 (e.g. a "diversion flow passage" when the diverter insert is installed, or an "unimpeded flow passage" when the diverter insert is removed, see FIG. 8) that is substantially parallel to, and generally aligned with, the flow passage of the top and bottom portions. The cross-sectional flow area of the first flow passage 58 is shown for example to be substantially the same as the cross sectional flow area of the top and bottom portions 30, 40. The second region 56 of the central portion 50 of the body 20 provides a second flow passage 60 (e.g. "bypass flow passage") extending through the body 20 that is defined on one side by the diverter insert 80 and on the opposite side by the second wall 62 of the central portion 50 of the body 20 (i.e. adjacent and separate from the containment created by the diverter insert (see FIG. 2). The bypass flow passage 60 substantially follows the curved second surface 62 and is intended to be operational (or otherwise available for use) when the diverter insert 80 is installed. The bypass flow passage 60 has a cross sectional flow area (i.e. substantially normal to the flow path direction of the bypass flow passage) that is substantially equal to or greater than the cross sectional flow area of the top and bottom portions 30, 40, so that a flow area through the downspout is not reduced by the presence of the removable diverter insert 80. When the diverter insert 80 is removed from the central portion 50 of the body 20, the rainwater flows substantially unimpeded through the downspout (i.e. from the top portion to the bottom portion of the apparatus without being diverted through the opening).

The second side 62 of the central portion 50 of the body 20 is also shown to include an access panel 64 (e.g. door, hatch, flap, etc.) covering an access opening 66. The access panel 64 is preferably transparent to permit visual observation of the presence or absence of the diverter insert 80 within the body 20, and the assessment or progression of a debris blockage condition of the diverter insert 80 (i.e. when the diverter insert is present). The access panel 64 is coupled to the body 20 in a manner that is intended to provide easy access, such as by a hinge or other suitable pivot connection, and secure closure, such as by an interference fit or snap fit with the surrounding structure of the access opening 66 in the body 20. The access panel 64 and access opening 66 are intended to be provide in a shape (shown for example as substantially rectangular) and a size that is sufficient to permit installation and removal of the diverter insert 80 from the central portion 50 of the body 20. According to the illustrated embodiment, the transparent access panel 64 includes a handle 68 to facilitate ease of opening and closing the access panel 64.

Figure 2:
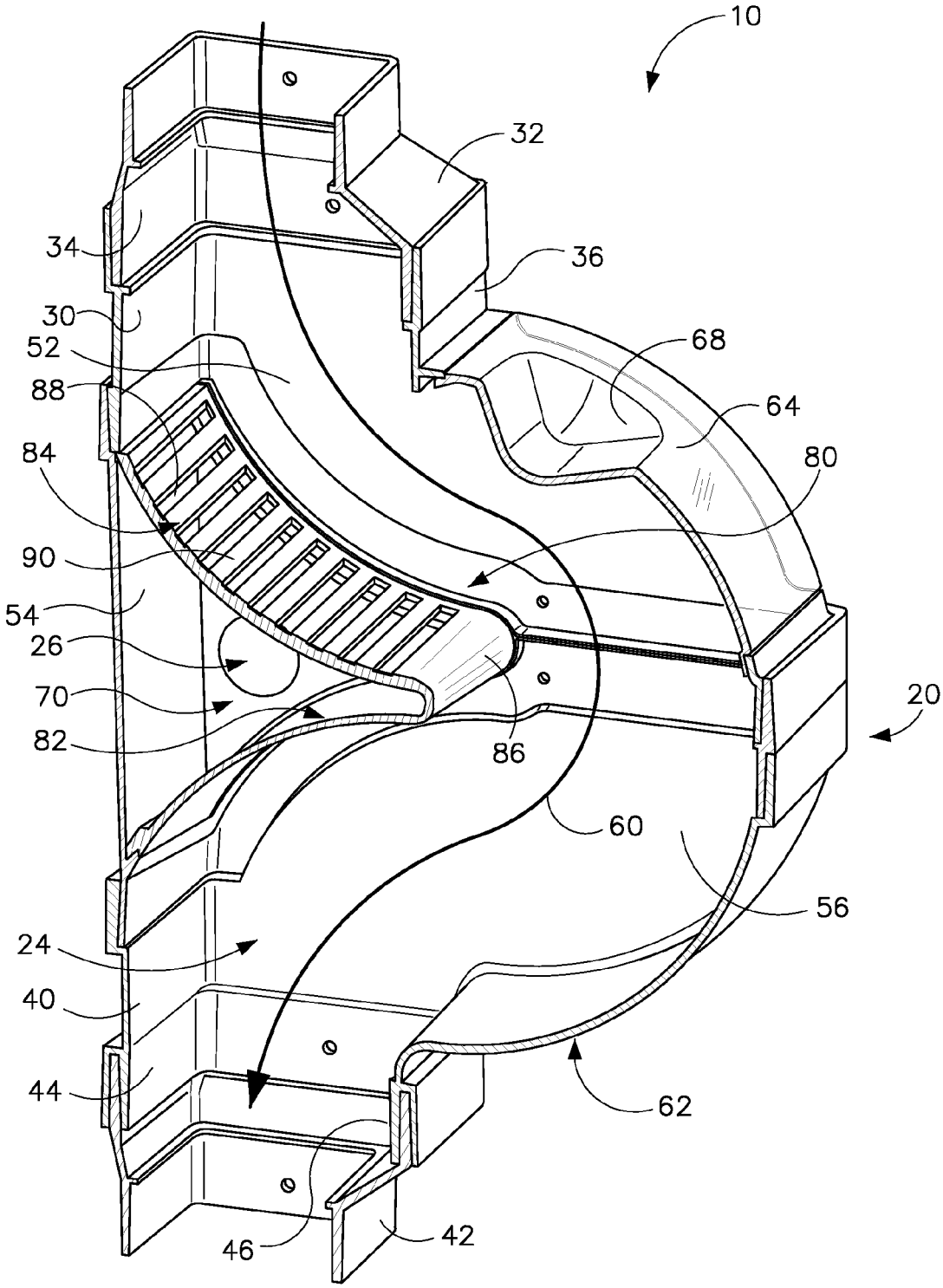
FIG. 2 is a schematic image of a cross-sectional perspective view of an apparatus for diverting rainwater according to an exemplary embodiment.
Figure 3:
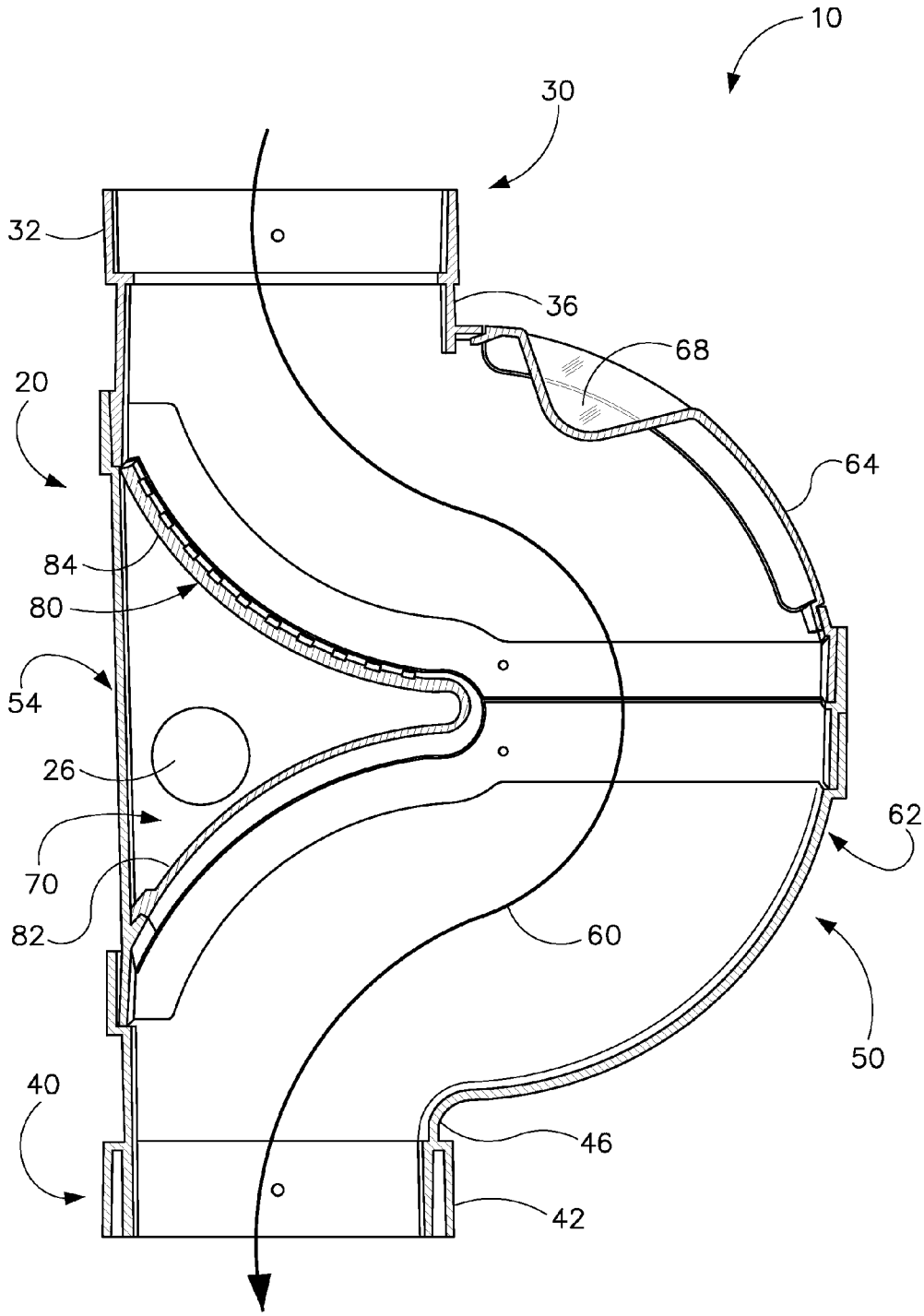
FIG. 3 is a schematic image of side elevation view of an apparatus for diverting rainwater according to an exemplary embodiment.
Figure 7:
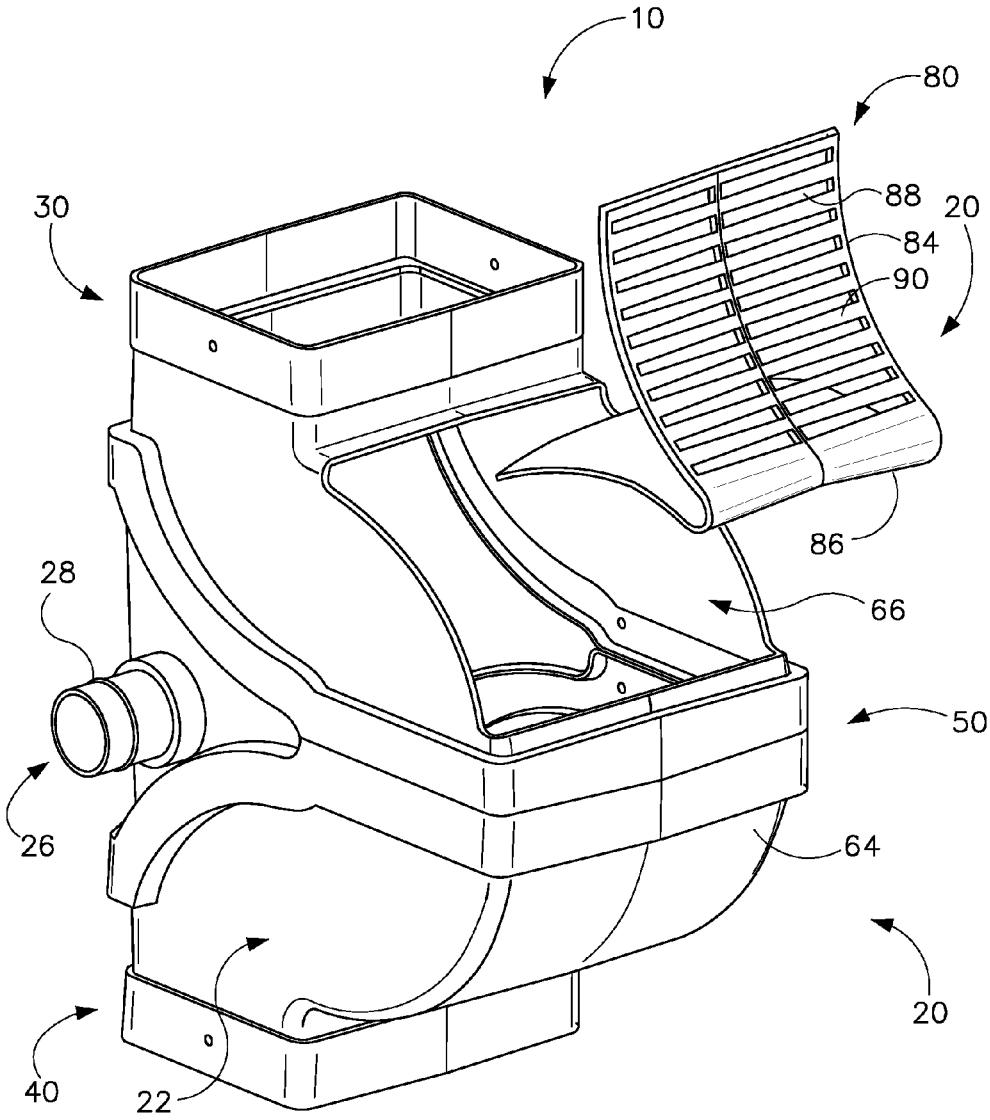
FIG. 7 is a schematic image of a perspective view of an apparatus for diverting rainwater with a removable diverter insert according to an exemplary embodiment.
Figure 9:
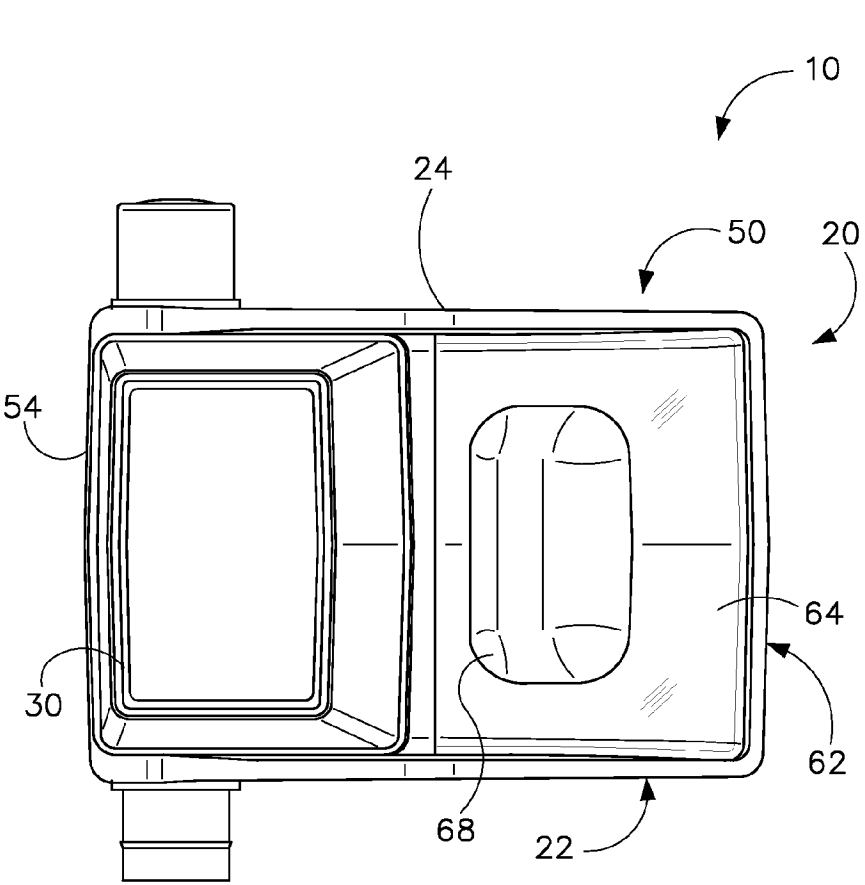
FIG. 9 is a schematic image of a top view of an apparatus for diverting rainwater with the diverter insert removed according to an exemplary embodiment.
Figure 8:
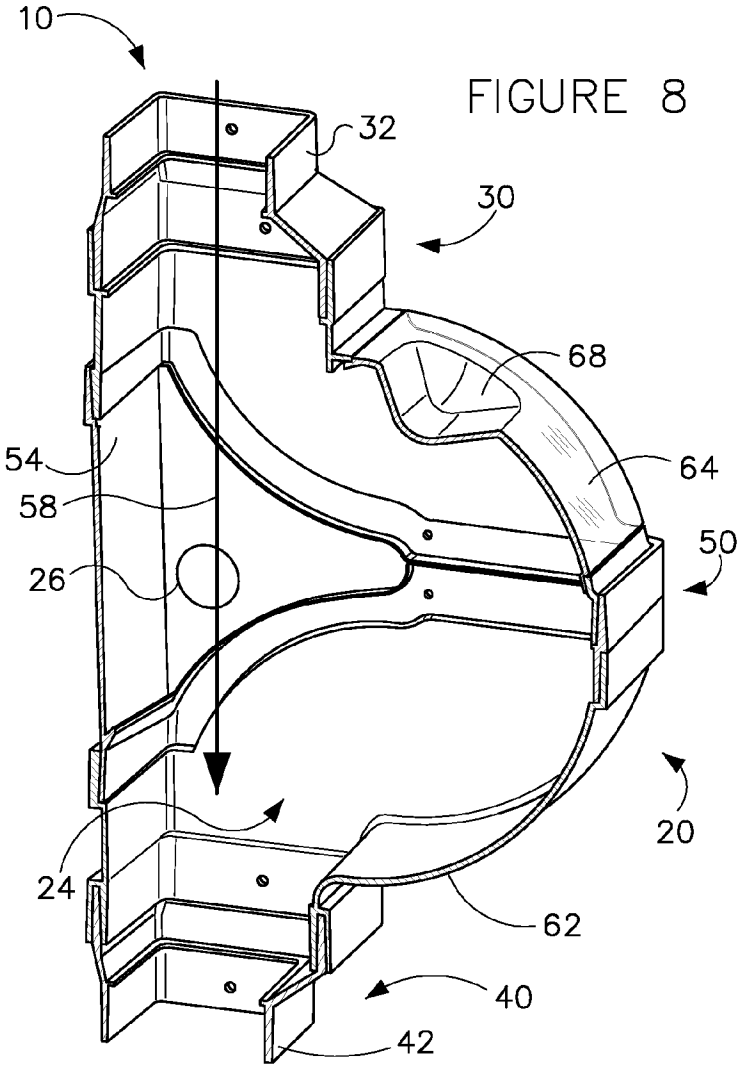
FIG. 8 is a schematic image of a cross-sectional perspective view of an apparatus for diverting rainwater with the diverter insert removed according to an exemplary embodiment.

Referring to FIGS. 2, 3 and 7, the removable diverter insert 80 is shown as a substantially V-shaped structure disposed within the central portion 50, and has a lower portion 82 and an upper portion 84. The diverter insert 80 may be removably secured within the central portion 50 using any suitable method. According to one embodiment, the diverter insert 80 is formed from a plastic material having a suitable degree of resiliency that permits the diverter insert 80 to secured by a snap-fit engagement with corresponding ridges provided in the front 22 and back 24 walls of the central portion 50 of the body 20. The upper portion 84 and lower portion 82 are joined along a common edge forming an apex 86 and have a substantially symmetric profile with surfaces that are outwardly concave (i.e. bowed inwardly).

The lower portion 82 of the diverter insert 80 is preferably formed as a solid wall or panel (i.e. without openings) to provide a surface that, together with first wall 54, the back 24 wall and the front wall 22 of the body 20, defines a containment 70 configured to capture rainwater that enters through the top portion 30. According to one embodiment, the containment 70 is substantially watertight, however, a certain amount of leakage may be tolerable according to other embodiment. The upper portion 84 of the diverter insert 80 includes a plurality of apertures 88, shown for example as slots that create a series of slats 90 (e.g. "fins", etc.) in the upper portion 84, but may be any other suitable apertures, such as a pattern of other shaped openings configured to permit passage of rainwater from the top portion 30 of the body 20, through the upper portion 84 of the diverter insert 80 to the containment 70. The upper portion 84 with the plurality of apertures 88 is intended to serve as a filter or strainer for filtering debris that may enter the body 20 from the downspout. The fins 90 are preferably sloped (e.g. tilted, angled, tipped, etc.) somewhat in a direction from the first wall 54 of the body 20 to the second wall 62 of the body 20, and tend to overlap one another, such that debris that enters the body 20 and impinges upon, or collects on, the diverter insert 80 tends to be carried (e.g. pushed, washed, sluiced, etc.) by the incoming rainwater progressively down the fins 90 until the debris reaches the apex of the diverter, after which the debris tends to wash-off (e.g. fall-off, etc.) the apex 86 of the diverter insert 80 where it may exit through the bottom portion 40 of the body 20.

Figure 4:
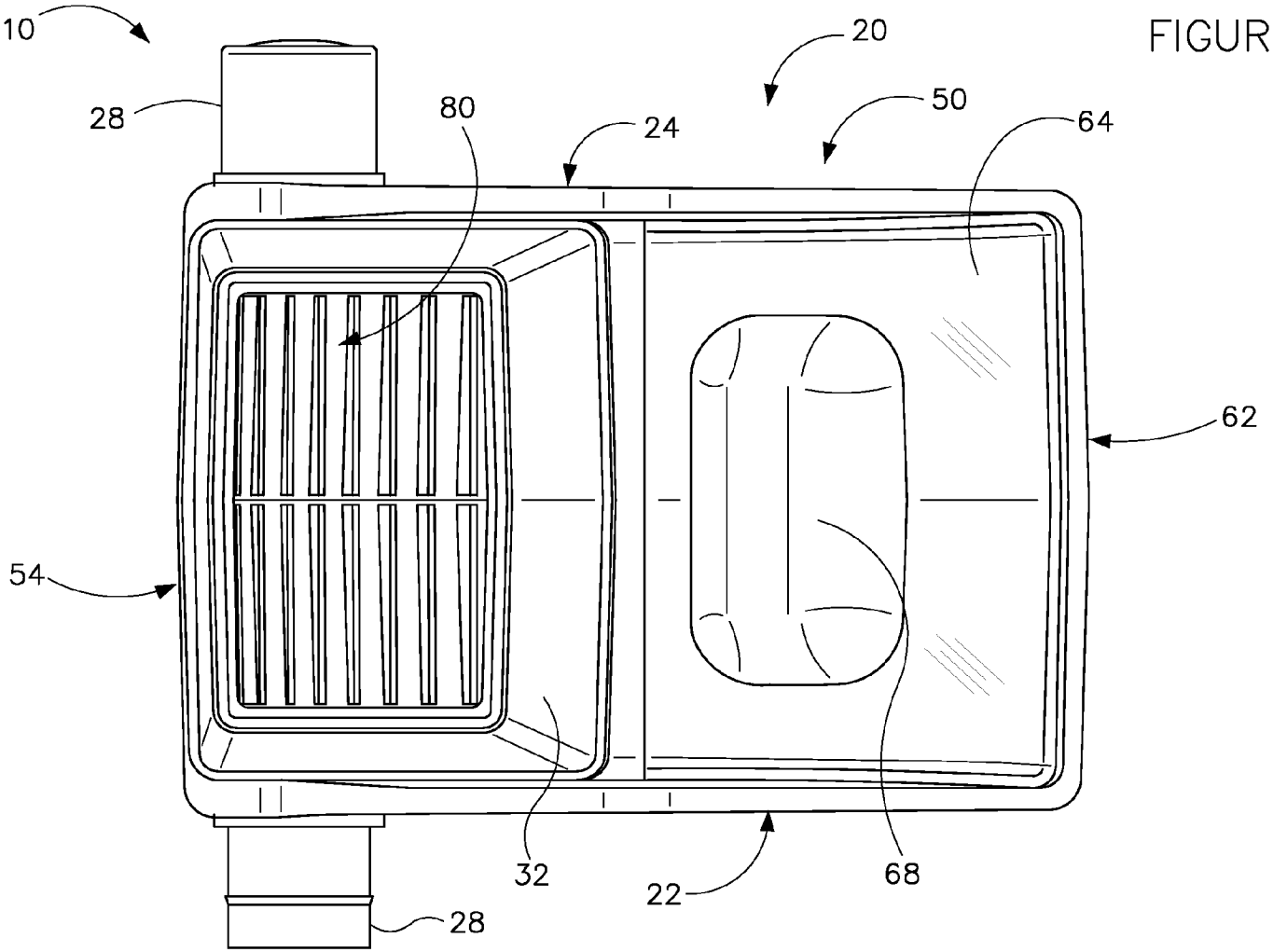
FIG. 4 is a schematic image of a top view of an apparatus for diverting rainwater according to an exemplary embodiment.
Figure 5:
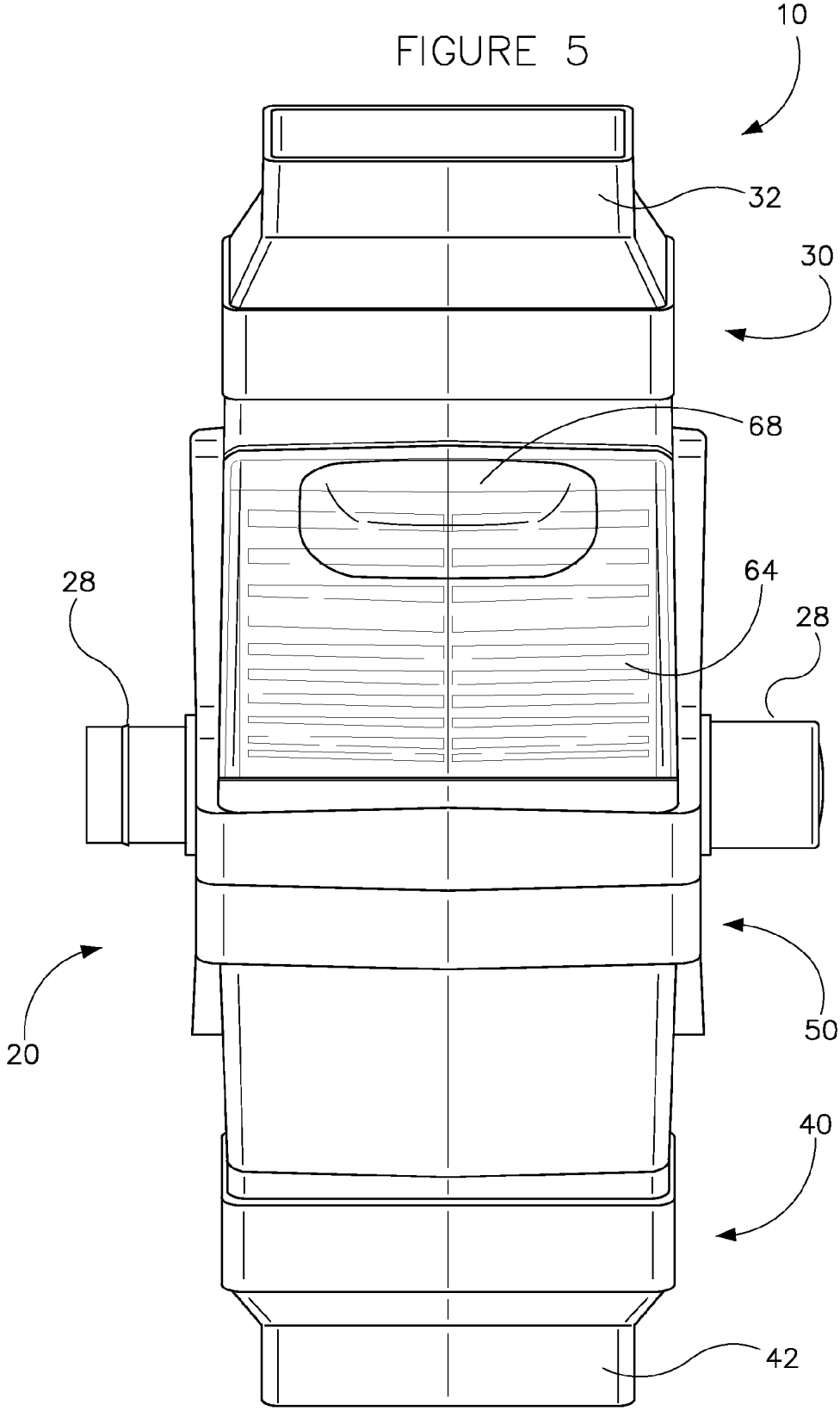
FIG. 5 is a schematic image of a front elevation view of an apparatus for diverting rainwater according to an exemplary embodiment.
Figure 6:
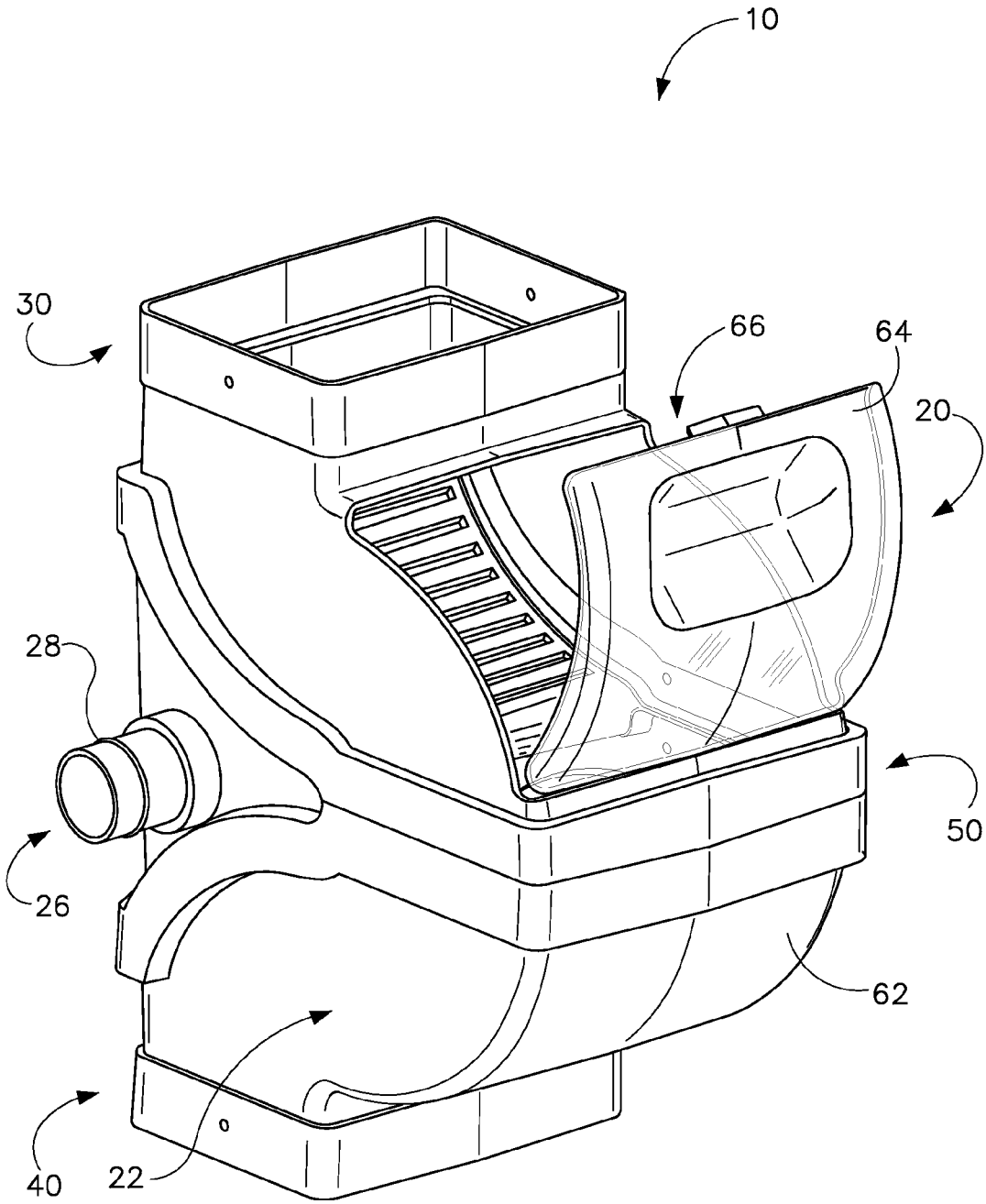
FIG. 6 is a schematic image of a perspective view of an apparatus for diverting rainwater with an open access panel according to an exemplary embodiment.
Figure 10:
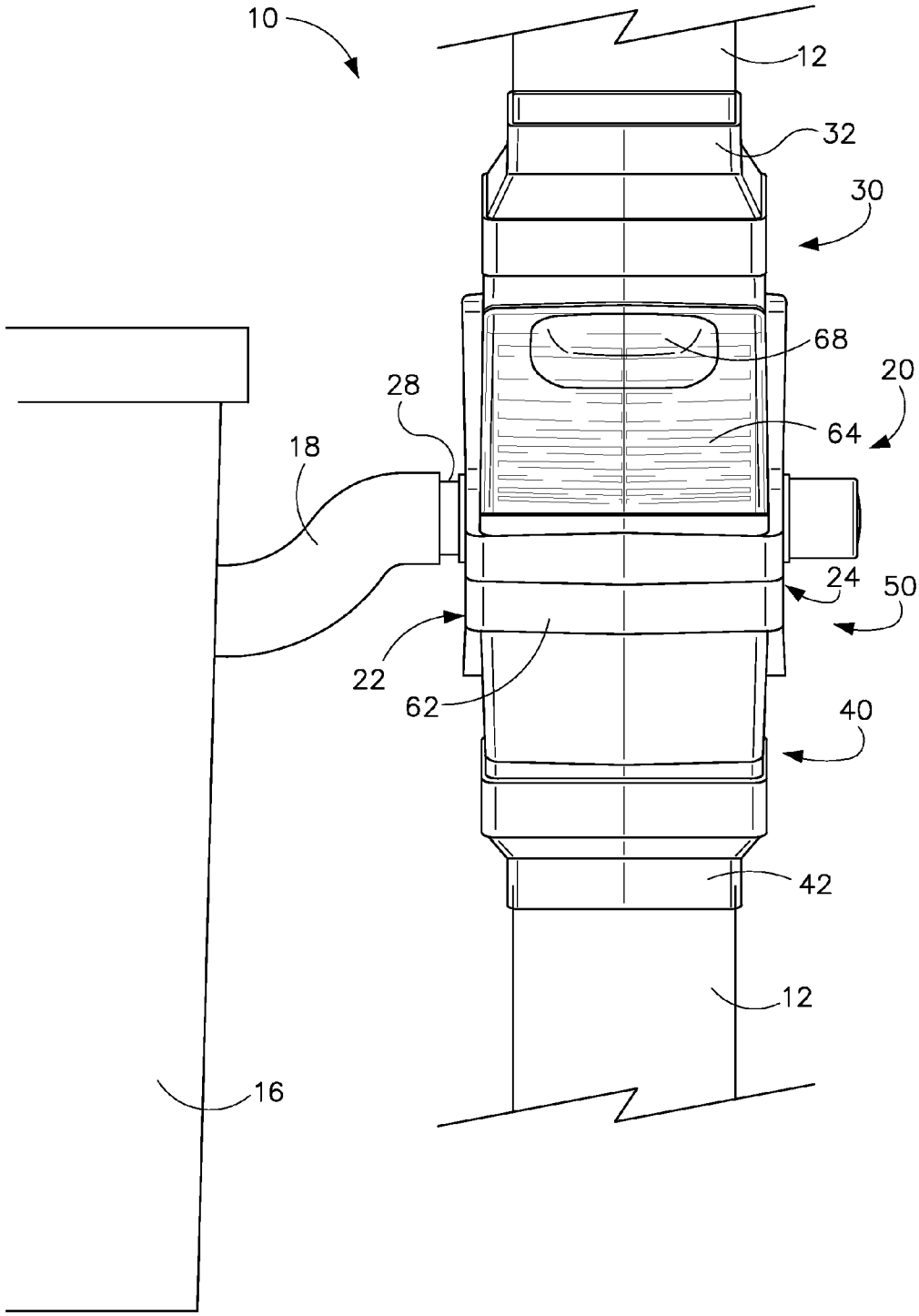
FIG. 10 is a schematic image of an apparatus for diverting rainwater to a collection device according to an exemplary embodiment.

An opening 26 is provided in at least one of the walls of the body (shown by way of example as a substantially circular opening in each of the front 22 and back 24 walls in FIGS. 4 and 5) and is configured to divert rainwater from the containment 70 to a collection device 16 such as a vessel (e.g. rain barrel, tank, etc.) or other collection device (e.g. retention pond, reservoir, etc.) or other suitable device intended to receive the rainwater (see FIG. 10). By orienting the openings 26 along the vertical plane of the walls, the openings 26 remain substantially parallel to an unimpeded flow of rainwater through the downspout, so that when rainwater collection is not desired and the diverter insert 80 is removed from the central portion 50, the rainwater will flow down the first flow path 58 and not to the collection device 16. According to one embodiment, the opening(s) 26 are disposed at an elevation that is beneath a lowest one of the plurality of apertures 88 in the upper portion 84 of the diverter insert 80. The opening 26 may be provided with any suitable hardware 28 (e.g. pipe stub, tubular projection, collar, etc.) configured to receive or otherwise couple to a hose 18, (e.g., tube, pipe or other conduit, etc.) for conveying the captured rainwater from the containment 70 to the collection device 16. According to one embodiment shown in FIG. 10, the collection device 16 is shown for example as a vessel (e.g. rain barrel, etc.) having storage capacity extending at least as high as the elevation of the opening(s). The hose 18 enters the vessel 16 at an elevation that is equal to, or slightly below, the elevation of the opening 26, so that when the water level in the vessel reaches the elevation of the opening 26, any further rainwater that enters the containment 70 will overflow the containment 70 and flow outwardly through the apertures 88 in the upper portion 84 of the diverter insert 80 and spill over the apex 86, where it exits through the bottom portion 40 and into the downspout. The relative elevations of the vessel 16, hose 18 and openings 26 in the apparatus 10 as described are intended to prevent leakage of water from the top of the vessel 16 and to encourage water in the containment 70 to flow out through the apertures 88 in the upper portion 84 when the collection device 16 is full. The overflow of water from the containment 70 through the apertures 88 is also intended to provide a "self-flushing" feature of the diverter insert 80 as the water flowing outwardly through the apertures 88 tends to dislodge and wash-away any debris captured on the fins 90. The self-flushing feature of the apparatus 10 is intended to minimize the frequency with which the diverter insert 80 may need to be removed for cleaning, and the removable nature of the diverter insert 80 is intended to minimize or eliminate the need to remove the body 20 from the downspout to conduct cleaning or otherwise removing debris carried by the downspout that may collect in the body.

The diverter insert 80 may be conveniently removed from the central portion 50 of the body 20 (i.e. through the access opening 66 in the second wall 62), such as when diversion of water to a collection device is not desirable (e.g. during winter months in colder climate regions, etc. such as "winterizing" the apparatus so that ice and rainwater may flow directly through the first flow path, substantially unimpeded from the top portion to the bottom portion without being diverted through the opening(s). The ability to winterize the apparatus by simply removing the diverter insert is intended to avoid blockage of the device, such as may occur in conventional rainwater diverters, and to avoid having to seasonally remove the entire apparatus.

The Applicant believes that the apparatus for diverting rainwater as shown in the FIGURES and described herein is effective in diverting at least approximately 80% of the rainwater flow through a downspout during low flow conditions. The Applicant also believes that the ability to winterize the apparatus in climates that have periods with temperatures below freezing (as opposed to conventional designs that typically collect water in a trough or internal reservoir) substantially minimizes the likelihood of damage by ice formation, where ice formation tends to collect, and impede the flow of water through the downspout and cause a backup of ice, water and/or debris that may also cause damage to the gutter system. The Applicant further believes that the provision of a full-flow bypass flow passage within the body provides superior performance with respect to conventional diverters that reduce or impede rainwater flow or direct the entirety of the rainwater to flow through a filter, because during periods of heavy rainfall, the increased flow through a conventional diverter can potentially back-up inside the upper downspout segment which may cause damage to the gutter system due to the added weight of the column of water. The Applicant also believes that the apparatus as shown and described to return overflow rainwater to the original downspout flow path (e.g. away from the building) is superior with respect to conventional diverters that divert the entirety of the flow into a collection reservoir (such as a rain-barrel or reservoirs under 100 gallons) which tend to overflow and spill at the collection location, and may potentially damage surrounding elements the building structure.

According to any exemplary embodiment, an apparatus for diverting rainwater includes a body having a top portion, a bottom portion, and a central portion. A removable diverter insert is disposed within the central portion, and has a lower portion and an apertured upper portion. The lower portion of the diverter, together with the front, back and side walls of the body defines a containment configured to capture rainwater that enters through the top portion. An opening in at least one of the walls of the body is configured to divert rainwater from the containment to a collection device. The body also includes a bypass flow area extending through the central portion adjacent to, and separate from, the containment, where the bypass flow area has a cross-sectional area that is substantially equal to or greater than a cross sectional area of the top and bottom portions, so that a flow area through the downspout is not reduced by the removable diverter insert. When the diverter is removed from the central portion through an access opening in the body, the rainwater flows substantially unimpeded through the downspout (i.e. from the top portion to the bottom portion of the apparatus without being diverted through the opening).

The apparatus for diverting rainwater thus provides a number of advantageous features including: allowing rainwater to flow to its original destination (as determined by the original downspout configuration) when the collection device is full; and filtering debris from the diverted rainwater, and self-flushing the filter; and maintaining or increasing the rated downspout size when the collection device is full; and providing a transparent removable access panel to assess any debris blockage condition that may exist; permitting easy removal of the diverter insert when cleaning is determined to be necessary or when rainwater diversion is not desired, and requires no moving parts for its operation.

It is also important to note that the construction and arrangement of the elements of the rainwater diverter as shown schematically in the embodiments is illustrative only. Although only a few embodiments have been described in detail in this disclosure, those skilled in the art who review this disclosure will readily appreciate that many modifications are possible without materially departing from the novel teachings and advantages of the subject matter recited. For example, the apparatus may be used as a large debris filter for a fluid collection systems that also needs an overflow device for periods of fluid flow which is faster than a collection system can receive.

Accordingly, all such modifications are intended to be included within the scope of the present invention. Other substitutions, modifications, changes and omissions may be made in the design, operating conditions and arrangement of the preferred and other exemplary embodiments without departing from the spirit of the present invention.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the present invention as expressed in the appended claims.

What is claimed is:

1. In a rain gutter system having a downspout, the improvement comprising an apparatus for diverting rainwater, including:

a body capable of being fluidically disposed within said downspout and having a top portion, a bottom portion, and a central portion;

a diverter disposed within the central portion and having a lower portion and an upper portion, said upper portion comprising a plurality of alternating slots and fins arranged so that the fins at least partially overlap one another, the lower portion of the diverter, together with one or more walls of the body, defining a containment configured to capture rainwater that enters through the top portion, wherein the lower portion and the upper portion of the diverter are joined at a common edge to form a substantially V-shaped structure and wherein the body includes a bypass flow passage extending through the central portion adjacent to, and separate from, the containment, the bypass flow passage comprises a cross sectional area that is substantially equal to or greater than a cross sectional area of the top and bottom portions; and an opening disposed in at least one of the walls of the body and configured to divert rainwater from the containment.

2. The apparatus of claim 1 wherein the diverter is removably attached to the body, so that with the diverter removed the rainwater flows substantially unimpeded from the top portion to the bottom portion without being diverted through the opening.

3. The apparatus of claim 1 wherein the opening is disposed beneath a lowest one of the plurality of slots in the upper portion of the diverter.

4. The apparatus of claim 1 further comprising an access panel in one of the walls of the body and movable between an open position and a closed position, and having a size sufficient to permit removal of the diverter from the body.

5. The apparatus of claim 4 wherein the access panel comprises a transparent portion configured to permit visual assessment of a debris blockage condition on the plurality of slots of the upper portion of the diverter.

6. The apparatus of claim 1 wherein the opening is operably coupled to a rainwater collection device.

7. The apparatus of claim 6 wherein the rainwater collection device is disposed at an elevation configured to permit rainwater in the containment to overflow through the plurality of slots in the upper portion of the diverter and to exit the body through the bottom portion when a rainwater level in the rainwater collection device reaches a predetermined level.

* * * * *